US006749295B2

(12) United States Patent
Kim et al.

(10) Patent No.: US 6,749,295 B2
(45) Date of Patent: Jun. 15, 2004

(54) INK-JET CARTRIDGE

(75) Inventors: Moo-youl Kim, Seoul (KR); Seo-hyun Cho, Gyeonggi-do (KR); Hyung-hyu Hwang, Gyeonggi-do (KR); Myung-song Jung, Gyeonggi-do (KR); Jae-cheol Lee, Gyeonggi-do (KR); Young-su Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/330,318

(22) Filed: Dec. 30, 2002

(65) Prior Publication Data

US 2003/0227525 A1 Dec. 11, 2003

(30) Foreign Application Priority Data

Jun. 5, 2002 (KR) ..... 2002-31612

(51) Int. Cl.[7] ..... B41J 2/175
(52) U.S. Cl. ..... 347/87; 347/86
(58) Field of Search ..... 347/85, 86, 87, 347/92

(56) References Cited

U.S. PATENT DOCUMENTS

| | | | | |
|---|---|---|---|---|
| 5,489,932 A | * | 2/1996 | Ceschin et al. | 347/87 |
| 5,502,479 A | * | 3/1996 | Ishinaga et al. | 347/93 |
| 5,537,136 A | * | 7/1996 | Brandon et al. | 347/87 |
| 5,815,184 A | * | 9/1998 | Ujita et al. | 347/87 |
| 5,898,449 A | * | 4/1999 | Narang et al. | 347/87 |
| 5,898,450 A | * | 4/1999 | Ahn | 347/87 |

* cited by examiner

*Primary Examiner*—Anh T.N. Vo
(74) *Attorney, Agent, or Firm*—Staas & Halsey LLP

(57) ABSTRACT

An ink-jet cartridge includes a cartridge body forming an ink reservoir, a standpipe coupled to one side of the ink reservoir, a printhead formed under an ink supply passage formed by the standpipe, through which ink from the ink reservoir is ejected onto a printing medium in a droplet shape, and a filter which covers a top portion of the standpipe. The filter is formed in a convex shape protruding toward the printhead. Ink particles and bubbles flowing from the ink reservoir to the printhead are filtered out, bubbles which may flow from the printhead to the ink reservoir, move to edges of the filter, and the ink is smoothly supplied to the printhead.

20 Claims, 4 Drawing Sheets

INK-JET CARTRIDGE

CROSS-REFERENCE TO RELATED APPLICATIONS

This application claims the priority of Korean Patent Application No. 2002-31612, filed Jun. 5, 2002, in the Korean Intellectual Property Office, the disclosure of which is incorporated herein in its entirety by reference.

BACKGROUND OF THE INVENTION

1. Field of the Invention

The present invention relates to an ink-jet cartridge, and more particularly, to an ink-jet cartridge which includes a filter to control communication between a printhead and an ink reservoir filled with ink.

2. Description of the Related Art

FIG. 1 is a cross-sectional view of a conventional ink-jet cartridge 100 disclosed in U.S. Pat. No. 5,537,136. Referring to FIG. 1, the ink-jet cartridge 10 includes a cartridge body 11 including an ink chamber filled with a foam material 12. A filter 18 is positioned on a standpipe 14 at a lower portion of the cartridge body 11. The filter 18 isolates the foam material 12 containing ink from the standpipe 14. Ink which flows through the filter 18, is supplied to a printhead (not shown) through the standpipe 14. The filter 18 prevents a passage of bubbles and ink particles from the ink chamber into the printhead.

However, since the filter 18 is a dome-shaped filter and is deformed by a compression force caused by the foam material 12, a function of the filter 18 may be lowered. Also, since bubbles which flow from the printhead to an ink reservoir of the ink chamber, are collected on a center portion inside the dome-shaped filter 18, the ink cannot be smoothly supplied from the ink reservoir to the printhead.

SUMMARY OF THE INVENTION

To solve the above and other problems, it is an object of the present invention to provide an ink-jet cartridge which guides bubbles to move from a printhead toward edges of a filter and smoothly supplies ink from an ink reservoir to the printhead.

Additional objects and advantages of the invention will be set forth in part in the description which follows and, in part, will be obvious from the description, or may be learned by practice of the invention.

Accordingly, to achieve an aspect of the invention, an ink-jet cartridge includes a cartridge body forming an ink reservoir, a standpipe coupled to one side of the ink reservoir, a printhead formed on a lower portion of an ink supply passage formed by the standpipe, through which ink from the ink reservoir is ejected onto a printing medium in a droplet shape, and a filter which covers a top portion of the standpipe. The filter is formed in a convex shape toward the printhead.

It is possible that a hook is formed on an edge of the filter to be disposed on (coupled to) the top portion of the standpipe.

It is also possible that the filter is substantially formed in a hemispherical shape or a cone shape.

BRIEF DESCRIPTION OF THE DRAWINGS

These and/or other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
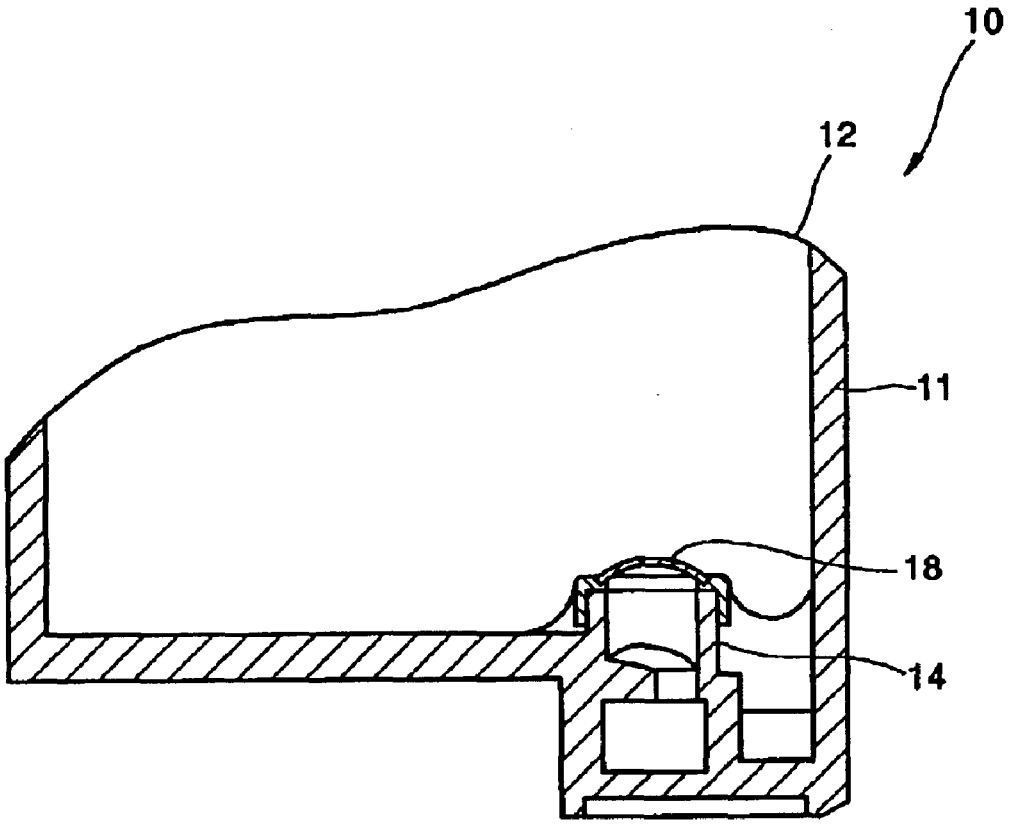
FIG. 1 (PRIOR ART)
FIG. 1 is a cross-sectional view of a conventional ink-jet cartridge.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The embodiments of the present invention will be described more fully hereinafter with reference to the accompanying drawings.

Figure 2:
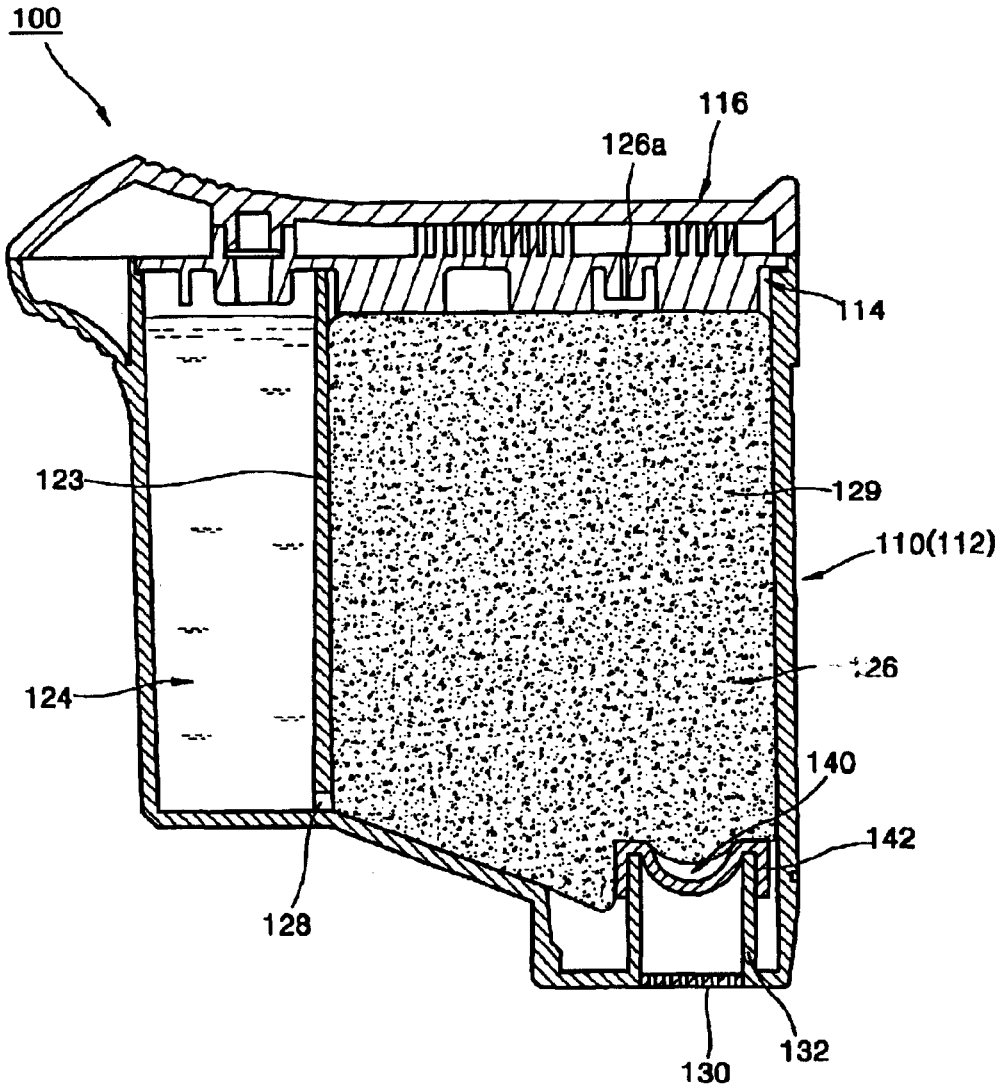
FIG. 2 is a cross-sectional side view of an ink-jet cartridge according to an embodiment of the present invention.

FIG. 2 is a cross-sectional side view of an ink-jet cartridge 100 according to an embodiment of the present invention. Referring to FIG. 2, the ink-jet cartridge 100 includes a cartridge body 110 forming an ink reservoir 112, an internal cover 114 covering a top portion of the ink reservoir 112, and an external cover 116, which is spaced-apart from the internal cover 114 by a predetermined gap, to seal the ink reservoir 112 and the internal cover 114.

The ink reservoir 112 is divided into first and second chambers 124 and 126 by a vertical barrier wall 123. An ink passage 128 between the first and second chambers 124 and 126 is formed on a bottom of the vertical barrier wall 123. Ink is filled in the first chamber 124, and a sponge 129 and ink are filled in the second chamber 126. A vent hole **126*a* which corresponds to the second chamber 126, is formed in the internal cover 114**.

A filter 140 is provided under the second chamber 126 to prevent an ejection hole of a printhead 130 from being clogged by filtering impurities and fine bubbles in the ink. Through the ejection hole of the printhead 130, the ink from the ink reservoir 112 is ejected onto a printing medium in a droplet shape. A standpipe 132 which supplies filtered ink to the printhead 130, is provided under the filter 140.

Figure 3:
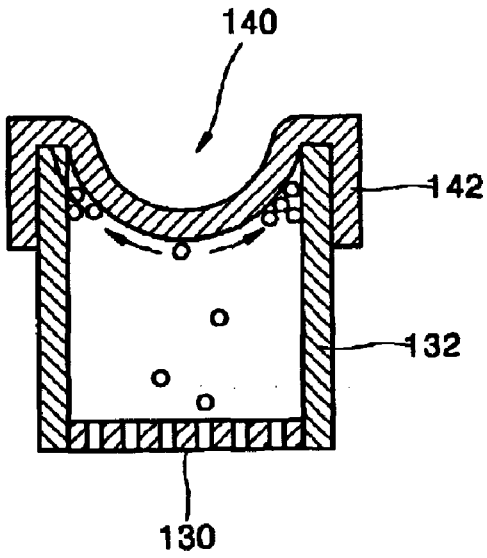
FIG. 3 is a cross-sectional enlarged view of a filter of the ink-jet cartridge shown in FIG. 2.

FIG. 3 is a cross-sectional enlarged view of the filter 140 of the ink-jet cartridge 100 of FIG. 2. Referring to FIG. 3, the filter 140 is a hemispherical filter having a convex shape from the ink reservoir 112 toward the printhead 130 and is provided on the standpipe 132. A hook 142 is formed on an edge (a rim portion) of the filter 140 to be disposed on (coupled to) a top portion of the standpipe 132. The hook 142 and the filter 140 may be formed in an integrated single body.

A function of the ink-jet cartridge 100 having the above structure will be described in detail with reference to the drawings.

If the ink-jet cartridge 100 that is maintained at a predetermined range of a negative pressure is mounted in an ink-jet printer (not shown), ink is supplied to the printhead 130 through the filter 140 disposed under the second chamber 126 and above the standpipe 132. In this case, bubbles and ink particles in the ink reservoir 112 are filtered out by the filter 140. The ink contained in the second chamber 126 is disposed in pores of the sponge 129. Owing to the negative pressure inside the second chamber 126 caused by use of the ink, air flows into the vent hole 126*a*, and the negative pressure is reduced such that an overly negative pressure which badly affects an ejection of the ink through the printhead 130 is prevented. Also, owing to a capillary action of the sponge 129, the ink in the first chamber 124 flows into the second chamber 126 through the ink passage 128.

When the overly negative pressure occurs in the ink reservoir 112 caused by the use of a printer, air may flow into the ink reservoir 112 through the printhead 130. As shown in FIG. 3, bubbles from the printhead 130 move to the edge (the rim portion) of the filter 140 due to a hemispherical shape of the filter 140. An ink supply from the ink reservoir 112 to the printhead 130 is performed through a center portion of the filter 140, which is a convex portion of the filter 140, and thus the ink is smoothly supplied from the ink reservoir 112 to the printhead 130. Also, the hook 142 formed on the edge (the rim portion) of the filter 140 is disposed on (coupled to) the top portion of the standpipe 132 when the filter 140 is assembled with the standpipe 132, and thus the ink is smoothly supplied from the ink reservoir 112 to the printhead 130.

Figure 4:
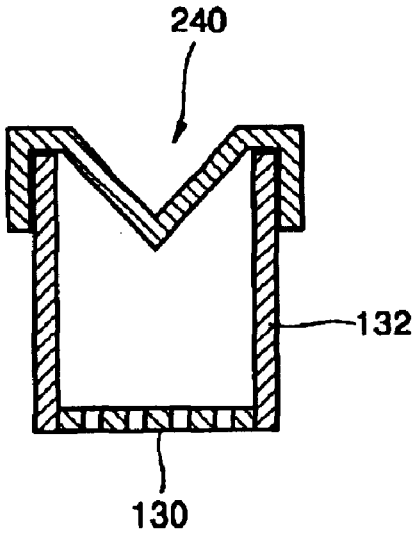
FIG. 4 illustrates another filter used in the ink-jet cartridge of FIG. 2 according to another embodiment of the present invention.

FIG. 4 illustrates another filter used in the ink-jet cartridge 100 of FIG. 2. Like reference numerals refer to like elements through the drawings, and detailed descriptions thereof will be omitted.

Referring to FIG. 4, a convex portion of a filter 240 formed on the standpipe 132 is formed in a cone shape. Another function of the filter 240 is the same as that of the hemispherical filter 140, and thus descriptions thereof will be omitted.

Figure 5:
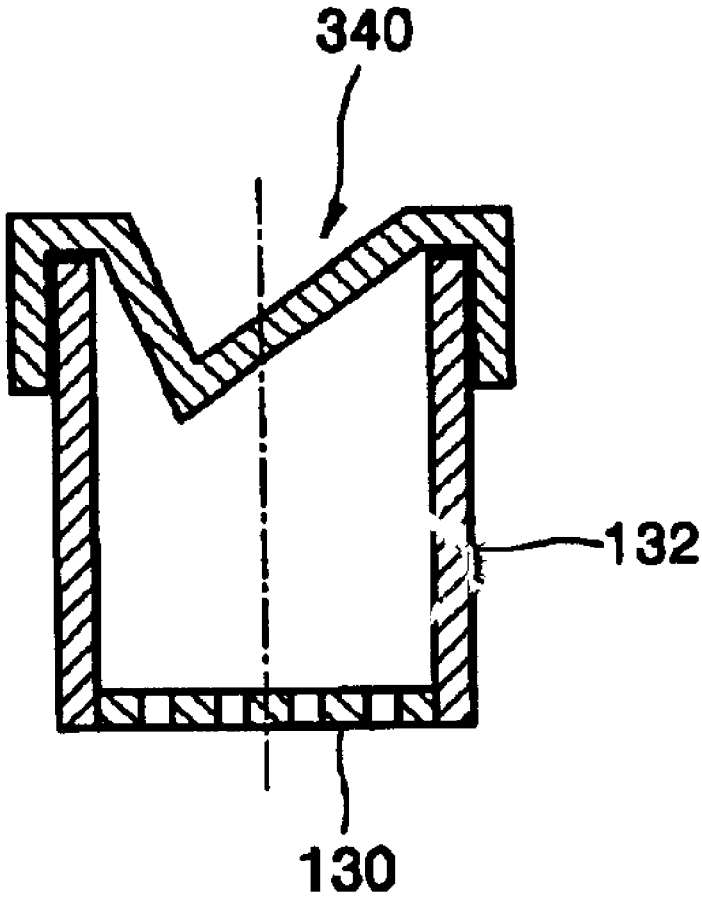
FIG. 5 illustrates another filter used in the ink-jet cartridge of FIG. 2 according to another embodiment of the present invention.

FIG. 5 illustrates another filter used in the ink-jet cartridge 100 of FIG. 2. Referring to FIG. 5, a lowest portion (a vertex portion) of a filter 340 having a cone shape formed on the standpipe 132 is formed to be spaced-apart from a vertical center line of the standpipe 132 by a gap. This variation in a shape of the filter 340 allows ink to be supplied to the printhead 130 through the vertex portion of the filter 140 other than a center portion of the filter 340 corresponding to the vertical center line of the standpipe 132 where a speed of an air flow is higher when air flows from the printhead 130. Thus, the ink supply from the ink reservoir 112 to the printhead 130 is performed more smoothly.

While the sponge 129 having a porous form is used as a unit maintaining the negative pressure of the ink-jet cartridge in the present embodiment, the filters 140, 240, and 340 having the above structures may be used in another ink-jet cartridge employing another type of unit, such as a spring, maintaining the negative pressure.

In addition, while the ink-jet cartridge having one ink reservoir is shown in the present embodiment for convenience and as an example, the present embodiment may be applied to a color ink-jet cartridge having three or more ink reservoirs.

As described above, in the ink-jet cartridge according to the present invention, ink particles and bubbles flowing from the ink reservoir to the printhead are filtered out, the bubbles which may flow from the printhead to the ink reservoir, move to the edge (rim portion) of the filter, and the ink is smoothly supplied to the printhead.

While this invention has been particularly shown and described with reference to a preferred embodiment thereof, it will be understood by those skilled in the art that various changes in form and details may be made therein without departing from the spirit and scope of the invention as defined by the appended claims and their equivalents.

What is claimed is:

1. An ink-jet cartridge comprising:

a cartridge body forming an ink reservoir;

a standpipe coupled to one side of the ink reservoir to form an ink supply passage;

a printhead formed in a portion of the ink supply passage of the standpipe, through which ink from the ink reservoir is ejected onto a printing medium in a droplet shape; and a filter which covers a top portion of the standpipe;

wherein the filter is formed in a convex shape protruding toward the printhead.

2. The ink-jet cartridge of claim 1, wherein the filter comprises:

a hook formed on an edge of the filter to be disposed on the top portion of the standpipe.

3. The ink-jet cartridge of claim 1, wherein the filter comprises:

a hemispherical shape.

4. The ink-jet cartridge of claim 1, wherein the filter comprises:

a cone shape.

5. The ink-jet cartridge of claim 4, wherein the filter comprises:

a vertex portion spaced-apart from a center line of the standpipe by a gap.

6. The color ink-jet cartridge of claim 5, wherein the filter comprises:

a hemispherical shape.

7. A color ink-jet cartridge which comprises a plurality of ink reservoirs each of which filled with a predetermined color of ink in a cartridge body, each ink reservoir comprising:

a standpipe coupled to one side of the ink reservoir to form an ink supply passage;

a printhead formed in a portion of the ink supply passage of the standpipe, through which ink of the ink reservoir is ejected onto a printing medium in a droplet shape; and a filter which covers a top portion of the standpipe;

wherein the filter is formed in a convex shape toward the printhead.

8. The color ink-jet cartridge of claim 7, wherein the filter comprises:

a hook formed on an edge of the filter to be disposed on the top portion of the standpipe.

9. The color ink-jet cartridge of claim 7, wherein the filter comprises:

a cone shape.

10. The color ink-jet cartridge of claim 9, wherein the filter comprises:

a vertex portion spaced-apart from a center line of the standpipe by a gap.

11. An ink-jet cartridge comprising:

a cartridge body forming an ink reservoir containing ink;

a printhead formed on a side of the cartridge body;

a standpipe disposed between the ink reservoir and the print head to form an ink supply passage through which the ink moves toward the printhead; and a filter disposed in the ink supply passage of the standpipe and having a convex shape portion protruding toward the printhead.

12. The ink-jet cartridge of claim 11, wherein the filter comprises:

a rim portion attached to an outside of the standpipe.

13. The ink-jet cartridge of claim 12, wherein the convex shape portion of the filter is disposed in an inside of the standpipe.

14. The ink-jet cartridge of claim 12, wherein the rim portion and the convex shape portion are formed in an integrated single body.

15. The ink-jet cartridge of claim 12, wherein the ink reservoir comprises a foam material contacting the rim portion of the filter and not contacting the convex shape portion of the filter.

16. The ink-jet cartridge of claim 11, wherein the ink reservoir comprises:

a portion protruding toward an inside of the standpipe and disposed in the ink supply passage of the standpipe.

17. The ink-jet cartridge of claim 11, wherein:

the ink reservoir comprises a foam material having a portion disposed in the standpipe; and the filter comprises a vertex portion formed on the convex shape portion and spaced-apart from the portion of the foam material by a distance.

18. The ink-jet cartridge of claim 11, wherein the standpipe comprises a center line, and the filter comprises:

a vertex portion formed on the convex shape portion and spaced apart from the center line of the standpipe.

19. The ink-jet cartridge of claim 11, wherein the cartridge body comprises:

another reservoir having the standpipe and the filter.

20. The ink-jet cartridge of claim 11, wherein the cartridge body comprises:

one of a sponge and a spring contained in the cartridge body to maintain a negative pressure when the ink is ejected through the standpipe and the printhead from the ink reservoir of the cartridge body.

* * * * *